US009055807B2

(12) United States Patent
Dale

(10) Patent No.: US 9,055,807 B2
(45) Date of Patent: Jun. 16, 2015

(54) WEDGE-SHAPED PAINTBRUSH

(71) Applicant: James C. Dale, Las Vegas, NV (US)

(72) Inventor: James C. Dale, Las Vegas, NV (US)

( * ) Notice: Subject to any disclaimer, the term of this patent is extended or adjusted under 35 U.S.C. 154(b) by 7 days.

(21) Appl. No.: 13/904,386

(22) Filed: May 29, 2013

(65) Prior Publication Data

US 2014/0196237 A1 Jul. 17, 2014

Related U.S. Application Data

(63) Continuation of application No. 29/452,394, filed on Apr. 16, 2013, now Pat. No. Des. 710,115.

(60) Provisional application No. 61/753,366, filed on Jan. 16, 2013.

(51) Int. Cl.
*A46B 9/02* (2006.01)
*A46B 3/12* (2006.01)

(52) U.S. Cl.
CPC ..... *A46B 9/026* (2013.01); *A46B 9/028* (2013.01); *A46B 3/12* (2013.01); *A46B 2200/202* (2013.01)

(58) Field of Classification Search
CPC ..... A46B 9/02; A46B 2200/1046; A46B 2200/202; B05C 17/00
USPC ..... 15/159.1, 160, 167.3, 190, 207.2; 132/320; D4/135, 138
See application file for complete search history.

(56) References Cited

U.S. PATENT DOCUMENTS

| | | | | |
|---|---|---|---|---|
| 2,099,030 A | | 11/1937 | Morrison | |
| 3,359,589 A | * | 12/1967 | Moore | 15/210.1 |
| 4,128,913 A | | 12/1978 | Scholl | |
| 4,483,036 A | | 11/1984 | Sayklay | |
| 4,590,637 A | | 5/1986 | Marino | |
| 4,738,001 A | * | 4/1988 | Shipp | 15/106 |
| 4,898,193 A | | 2/1990 | Gueret | |
| D306,493 S | * | 3/1990 | Pessis | D28/7 |
| 4,998,315 A | | 3/1991 | Pessis | |
| 5,218,733 A | | 6/1993 | Leu | |
| 5,450,865 A | * | 9/1995 | Park | 132/218 |
| 5,507,063 A | | 4/1996 | Hirsch | |

(Continued)

FOREIGN PATENT DOCUMENTS

| | | |
|---|---|---|
| AU | 315103 S | 4/2007 |
| GB | 276523 | 7/1927 |
| GB | 682725 | 11/1952 |

OTHER PUBLICATIONS

Design Business Association Design Effectiveness Awards 2011.

*Primary Examiner* — Laura C Guidotti

(74) *Attorney, Agent, or Firm* — Larson & Larson, P.A.; Justin P. Miller; Patrick A. Reid

(57) ABSTRACT

The wedge-shaped paintbrush is a paintbrush with characteristics ideal for trim work. The wedge cross-sectional shape creates a narrow trailing edge, resulting in a fine line for working close to corners and other edges. The wide leading edge acts as a storage location for paint due to its large quantity of bristles. The synergistic result is a paintbrush that has the narrow trailing line of a trim brush, but with the paint-carrying capacity of a larger brush. This allows the novice, who lacks the ability to control the large number of bristles in a larger brush, to effectively cut in a room in a short period of time, minimizing the quantity of times he must reload the brush with paint, or wipe off areas unintentionally painted.

18 Claims, 4 Drawing Sheets

(56) References Cited

U.S. PATENT DOCUMENTS

| | | | | |
|---|---|---|---|---|
| D380,615 | S | 7/1997 | Roberts | |
| 5,689,872 | A | 11/1997 | Forsline | |
| D566,969 | S | 4/2008 | Sherman et al. | |
| D578,773 | S | 10/2008 | Sherman et al. | |
| D584,513 | S | 1/2009 | Sherman et al. | |
| D584,514 | S | 1/2009 | Dale et al. | |
| 7,581,275 | B2 * | 9/2009 | Rekart | 15/160 |
| 7,895,698 | B2 | 3/2011 | Mink | |
| 2002/0194690 | A1 | 12/2002 | Vaes et al. | |
| 2008/0141479 | A1 * | 6/2008 | Mink | 15/207.2 |
| 2009/0011135 | A1 | 1/2009 | Cox et al. | |

* cited by examiner

WEDGE-SHAPED PAINTBRUSH

CROSS-REFERENCE TO RELATED APPLICATIONS

This application is a continuation-in-part of U.S. design patent application No. 29/452,394, filed Apr. 16, 2013, and claims priority to U.S. provisional patent application No. 61/753,366, filed Jan. 16, 2013.

FIELD

This invention relates to the field of paintbrushes.

BACKGROUND

The time consuming and complex part of painting lies in the detail work. Such work includes corners, trim, molding, windows, utility connections, and so forth. When confronted with such numerous items to paint around, a novice will reach for painter's tape. But applying tape to every surface adjacent to the area to be painted is time-consuming and wasteful.

Thus, a painter may wish to "cut in" the room first. Cutting in is the process of painting around the joints of the wall and the edges where the wall meets the ceiling or the moldings. A novice, lacking the steady hand of a professional, has to choose between two types of imperfect brushes. He can use an angled sash brush/peacock brush, but given the lack of fine control he is likely to accidently apply paint to adjoining surfaces. Or he can use a trim angle sash brush/rattail brush, but its small size results in many trips back to the paint bucket, negating the time benefit of skipping the tape.

What is needed is a paintbrush that provides the fine control and forgiveness of a small brush, but the paint-carrying capacity of a large brush.

SUMMARY

The wedge-shaped paintbrush is a paintbrush with characteristics ideal for trim work. The wedge cross-sectional shape creates a narrow trailing edge, resulting in a fine line for working close to corners and other edges. The wide leading edge creates internal storage for paint by virtue of a larger quantity of bristles. The synergistic result is a paintbrush that has the narrow trailing line of a trim brush, but with the paint-carrying capacity of a larger brush. This allows the novice, who lacks the ability to control the large number of bristles in a larger brush, to effectively cut in a room in a short period of time, minimizing the quantity of times he must reload the brush with paint or wipe off areas unintentionally painted.

Existing paintbrushes each have certain restrictions. A peacock brush includes a thick handle, not intended to be rotated in the user's hand. Its large size allows it to holds a large amount of paint. But that same large size prevents it from creating a fine line because the brush flattens during use, and with great breadth the bristles spread out. The result is a brush a novice has trouble using with any degree of control.

A rattail brush is long and round, intended to be turned in the hand of the user. It is ideal for fine lines around door jambs, etc. and often used by those who are less skilled, and thus need a brush with more control. Given that it has fewer bristles, it does not widen under pressure as much as the peacock brush. But it also holds less paint.

Put simply, the wedge-shaped paintbrush is a brush having a head with a substantially trapezoidal crosssection. The result is a brush head that has a leading edge and a trailing edge, the leading edge being of greater width/length than the trailing edge. The leading edge and trailing edge are connected by intermediate edges. The filaments that make up the brush fill the area bounded by these edges.

Alternatively, the wedge-shaped paintbrush comprises only a few elements of a handle and a brush head made of a ferrule and a multiplicity of filaments, the brush head having a narrow side and a broad side. The result is a number of potential cross-sectional shapes, including a trapezoid and a triangle. The intersections of the lines forming such shapes can be either pointed, rounded, or cropped (i.e., a point replaced with a straight line).

TERMINOLOGY

As used herein, a brush is any collection of filaments or bristles joined to a handle, used to transfer paint to a surface. For example, a brush can be a paint brush that can transfer paint, lacquer, varnish, stain, water sealant, and the like from a container to a surface.

Filament refers to any fiber, strand, or string-like element that, when collected together with other filaments, forms the brush head. A filament can be a natural fiber (e.g., animal hair) or a synthetic fiber (e.g., nylon, polybutylene).

A plug may be placed between the bristles to spread the bristles outward toward the sleeve so that the bristles are wedged between the plug and the sleeve.

The bristles and plug are often adhered together by adhesive, such as epoxy resins. Together the bristles, the plug, and the adhesive form a "knot" that retains the bristles in the sleeve.

Filaments are attached to the handle by way of a sleeve or ferrule that circumscribes an end of the bristles and a mating end of the handle. The ferrule is affixed to the handle by small nails, known as brad nails, by simple compression, adhesive, or other known attachment methods.

The handle itself can be of a multiplicity of shapes, including rat tail, beaver tail, and a handle often shorter than the filaments, known as a short handle. The handle can be of many materials, such as wood, rubber, plastic, and others.

How a Paintbrush Holds Paint

During use, the filaments of a paint brush are dipped into the paint, coating the filaments with paint. The paint is then transferred from the filaments to a surface through physical contact. When nearly all of the coating has been transferred from the filaments to the surface, the process is repeated.

Natural-bristle/filament brushes made with animal hairs are used for applying oil base paints, varnishes, shellac, polyurethane and other oil base finishes. The natural "flagging" (splitting or fuzzy tips) of these brushes creates split ends in the bristles that hold more paint and help assure a smooth paint release and finish.

Blended nylon/polyester brushes are easy to clean and work well with all types of latex paints. Synthetic fibers are more durable than natural fibers. Thus, with proper care, nylon/polyester brushes should last for years.

Polyester brushes are best for latex paints. These brushes hold their shape and stiffness in any paint and apply paint smoothly and evenly.

How Paintbrushes Apply Paint to a Surface

When applying paint, the head of the paintbrush is pulled, rather than pushed. While each part of the brush plays a part in the application of paint to the surface, the line that results from the passage of the bristles/filaments across the surface is defined by its trailing side.

The head of the wedge-shaped brush has multiple parts involved in the application of paint. The leading edge of the wedge-shaped brush is the wider portion of the head, and the first section of the brush to contact unpainted surface. Given its width, it is associated with the section of the brush that holds the majority of the paint.

The trailing edge of the wedge-shaped brush is narrower than the leading edge. The tapering of the sides of the brush as it transitions from the wide leading edge to the narrower trailing edge acts to route the flow of paint.

Within the wedge-shaped brush, there are multiple paths for the flow of paint from the wide section associated with the leading edge and the narrow section associated with the trailing edge. The first is by contact with the surface. The leading edge contacts the surface first, depositing paint. This deposited paint remains on the surface, being moved by the trailing edge.

The second path is internal to the brush. The filaments are all in either direct or indirect contact with each other. The same wicking, or capillary action, that acts to draw paint upwards to fill the spaces between the filaments also works horizontally. This horizontal action fills the spaces between adjacent filaments. The leading edge of the wedge-shaped paintbrush is part of a larger tail section of the brush, which with its many filaments act to hold a substantial amount of paint. This substantial amount of paint is then shared with the other parts of the brush, specifically the tip, which forms the trailing edge. The narrower profile of the tip holds less paint, but the availability of paint from the wider section of the brush prevents the tip from running dry.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
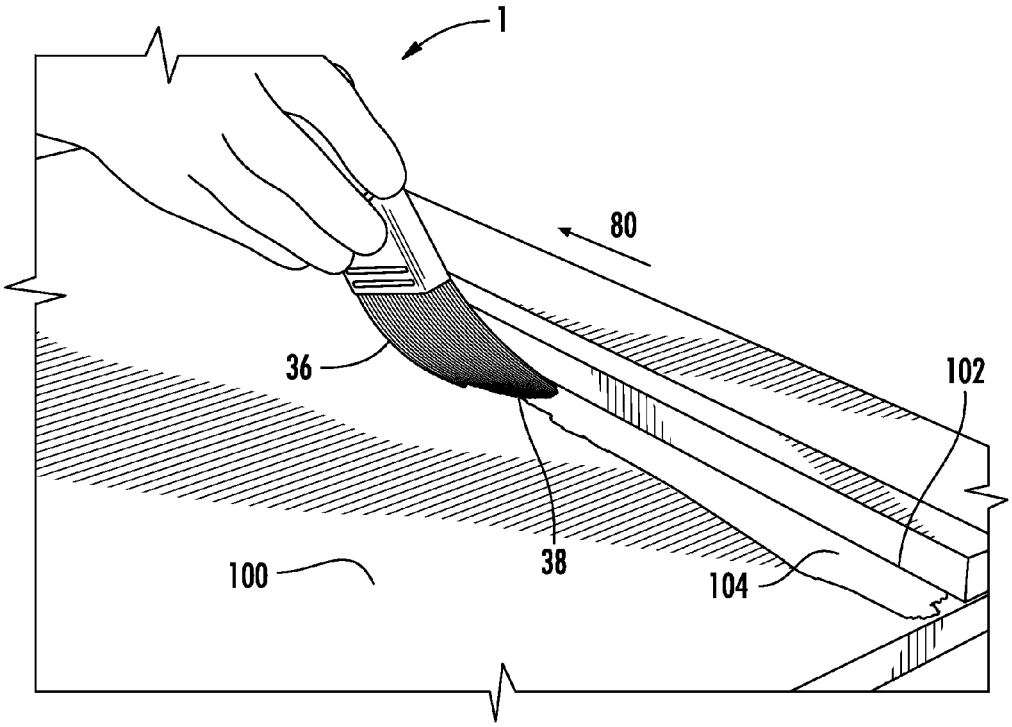
FIG. 1 illustrates the wedge-shaped paintbrush use, showing application

Reference will now be made in detail to the presently preferred embodiments of the invention, examples of which are illustrated in the accompanying drawings. Throughout the following detailed description, the same reference numerals refer to the same elements in all figures.

Referring to FIG. 1, the wedge-shaped paintbrush 1 is shown in use. The wedge-shaped paintbrush 1 is shown being used to paint a surface 100 along a corner 102, depositing paint 104. The direction of travel 80 is from the leading edge 36, the wider section of the wedge-shaped paintbrush 1, to the trailing edge 38, or the narrower section of the wedge-shaped paintbrush 1. As discussed, the brush is pulled, not pushed. The narrow trailing edge of the brush 1 allows paint 104 to be applied to the surface 100 very close to the corner 102, without contacting the adjoining vertical surface.

Figure 2:
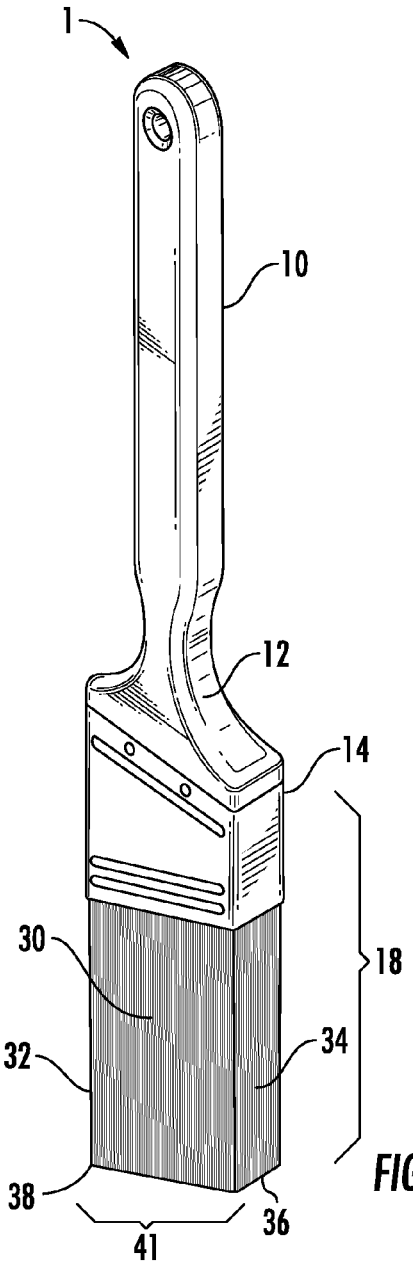
FIG. 2 illustrates an isometric view of the wedge-shaped paintbrush, showing its tail
Figure 3:
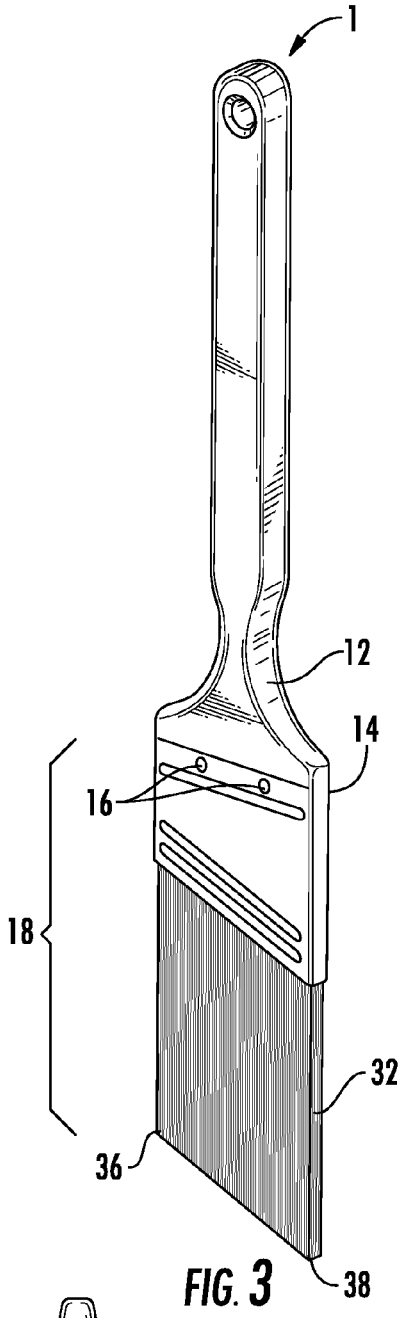
FIG. 3 illustrates an isometric view of the wedge-shaped paintbrush, showing its tip

Referring now to FIGS. 2 and 3, the components of the wedge-shaped paintbrush 1 will be described. The wedge-shaped paintbrush 1 includes a handle 10 with optional tapered grip 12. The filaments 30 are held to the handle 10 by the ferrule 14. In turn, the ferrule 14 is held to the handle by the ferrule fasteners 16. What results is the brush head 18.

The brush head 18 has a tip 32, or narrow section, and a tail 34, or wider section. The base of the tail 34 is the leading edge 36, and the base of the tip 32 is the trailing edge 38. The ends of the filaments are the filament tips 40, which collectively form the base 41.

Figure 4:
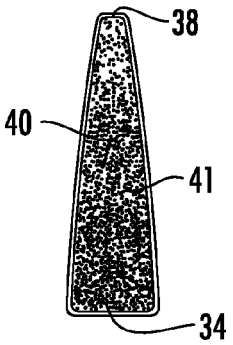
FIG. 4 illustrates a bottom view of the wedge-shaped paintbrush

Referring to FIG. 4, the base of the wedge-shaped paintbrush is shown. The filament tips 40 are shown, forming the base 41. The wedge shape of the brush 1 can be seen, with the tail 34 and the trailing edge 38.

Figure 5:
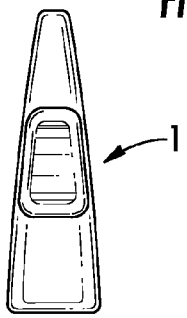
FIG. 5 illustrates a top view of the wedge-shaped paintbrush, showing its bristles

Referring to FIG. 5, the top of the wedge-shaped paintbrush is shown.

Figure 6:
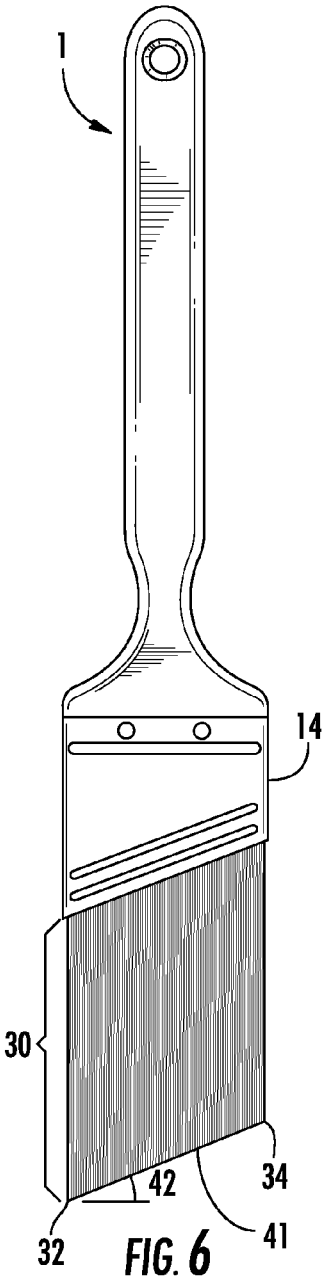
FIG. 6 illustrates a side view of the wedge-shaped paintbrush, showing the angle of the bristles
Figure 7:
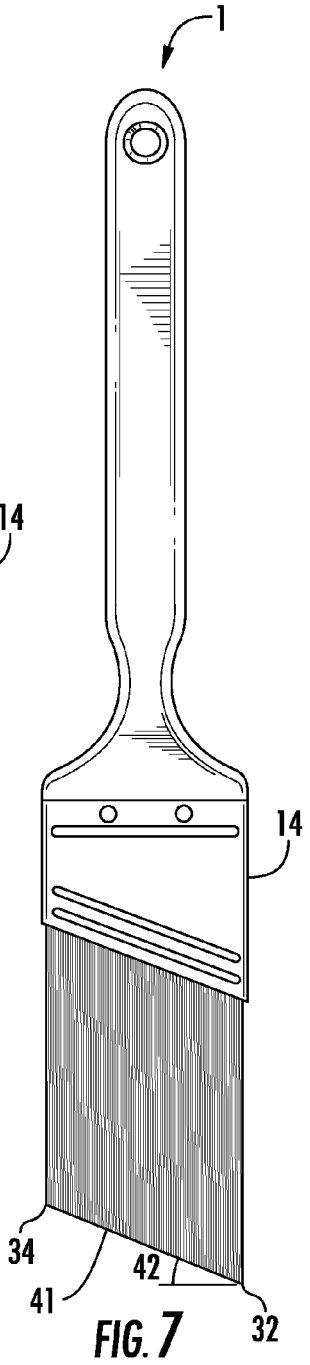
FIG. 7 illustrates an opposite side view of the wedge-shaped paintbrush, showing the angle of the bristles

Referring to FIGS. 6 and 7, side views of the wedge-shaped paintbrush are shown. The filament tip angle 42 is shown, the angle between horizontal and the angle of the base 41. For example, if the base 41 is perpendicular to the length of the filaments 30, the filament tip angle 42 is 90 degrees.

The filament tip angle 42 works in conjunction with the pulling actions of the brush 1 to result in smooth painting. When the brush 1 is being used, it is held against a surface 100 such that both the tip 32 and tail 34 contact the surface. The result is that the handle 10 of the brush is held at an angle roughly that of the filament tip angle 42.

Figure 8:
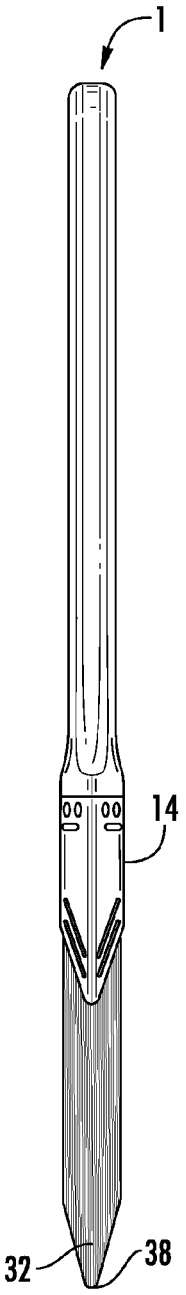
FIG. 8 illustrates a view of the trailing edge of the wedge-shaped paintbrush

Referring to FIG. 8, a view of the trailing edge 38 of the wedge-shaped paintbrush is shown.

Figure 9:
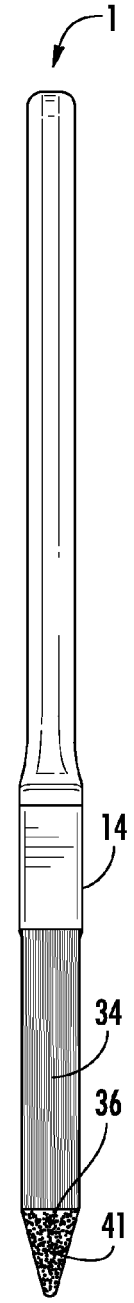
FIG. 9 illustrates a view of the leading edge of the wedge-shaped paintbrush

Referring to FIG. 9, a view of the leading edge 36 of the wedge-shaped paintbrush is shown.

Referring to FIGS. 10-15, exemplary cross-sections of the wedge-shaped paintbrush are shown.

Figure 10:
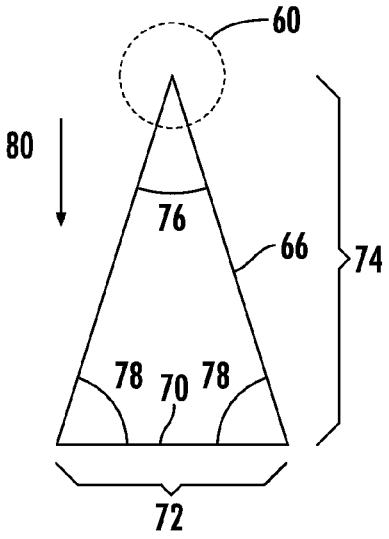
FIG. 10 illustrates an exemplary cross section the wedge-shaped paintbrush, showing a pointed tip and flat intermediate edges

FIG. 10 shows a pointed tip 60 and flat sides 66, a cross-sectional shape of the brush head that is a triangle. The tip angle 76 is shown, or the angle between the two flat sides 66. Tail angle 78 is also shown, or the angle between one of the flat sides 66 and the flat leading edge 70. The overall cross-section has a length 74 and a width 72.

Figure 11:
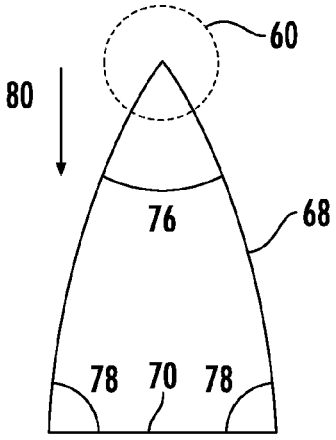
FIG. 11 illustrates an exemplary cross section the wedge-shaped paintbrush, showing a pointed tip and rounded intermediate edges

FIG. 11 shows an exemplary cross-section with pointed tip 60 and rounded intermediate edges 68. Here the tip angle 76 is shown, or the angle between the two rounded intermediate edges 68. Tail angle 78 is also shown, or the angle between one of the rounded intermediate edges 68 and the flat leading edge 70. It is appreciated that two curved lines do not meet at an angle in the same way as two straight lines. Instead, the angle between a straight line and a curved line is known as a mixed angle, and the angle between two intersecting curved lines is known as a curvilinear angle. Such angles are measured as the angle between the tangents at the point of intersection.

Figure 12:
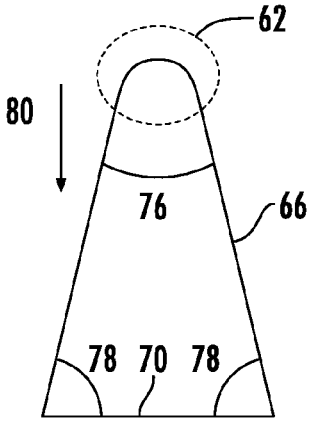
FIG. 12 illustrates an exemplary cross section the wedge-shaped paintbrush, showing a rounded tip and flat intermediate edges

FIG. 12 shows an exemplary cross-section with a rounded tip 62 and straight intermediate edges 66.

Figure 13:
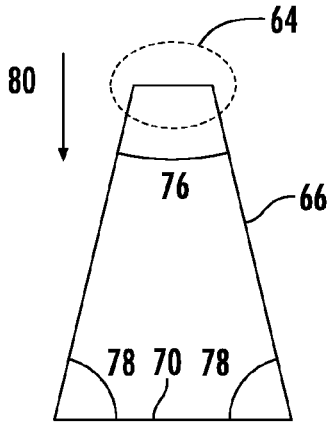
FIG. 13 illustrates an exemplary cross section the wedge-shaped paintbrush, showing a flat trailing edge and flat intermediate edges

FIG. 13 shows an exemplary cross-section with a flat tip 64 and straight intermediate edges 66, or the shape of a trapezoid with two parallel sides.

Figure 14:
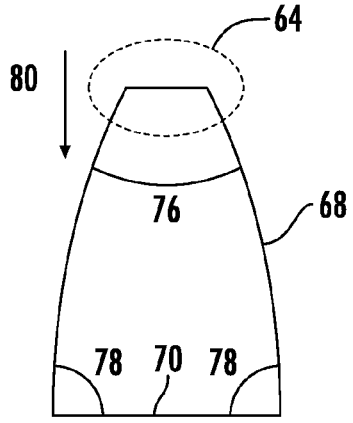
FIG. 14 illustrates an exemplary cross section the wedge-shaped paintbrush, showing a flat trailing edge and rounded intermediate edges

FIG. 14 shows an exemplary cross section with a flat trailing edge and rounded intermediate edges, or the shape of a trapezoid with rounded sides, and two parallel sides.

Figure 15:
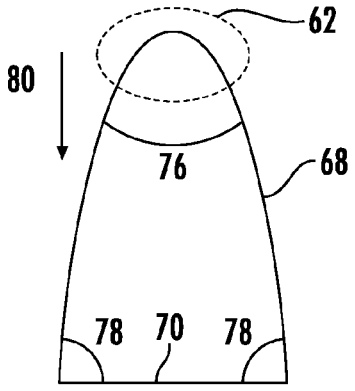
FIG. 15 illustrates an exemplary cross section the wedge-shaped paintbrush, showing a rounded tip and rounded intermediate edges

FIG. 15 illustrates an exemplary cross section with a rounded tip and rounded intermediate edges, or the shape of a trapezoid with rounded sides and rounded tip.

Referring to FIGS. 10-15 generally, certain characteristics are to be noted. The relationship between the tip angle 76 and tail angle 78 alters the shape of the brush, and thus its characteristics. A tip angle 76 equal to a tail angle 78 results in an equilateral triangle, with angles 76/78 of 60 degrees. The resulting shape does not have sufficient length 74 with respect to width 74, and thus does not realize the benefits of a properly proportioned wedge-shaped paintbrush 1.

The embodiment shown in the figures has a tail angle 78 of approximately 88 degrees, and a tip angle of approximately 20 degrees (the exemplary embodiment shown in the figures has curved sides, which results in the total of the angles being greater than 180 degrees).

It is anticipated that the most effective embodiments of the wedge-shaped paintbrush have a tail angle 78 of at least two times greater than the tip angle.

The different tips result in different brush characteristics. While a brush 1 with a pointed tip 60 will provide the majority of the advantages of the wedge-shaped paintbrush, the pointed tip 60 is easily damaged due to the very small number of filaments 30 present at the tip 32, and is less effective at holding a line due to the small number of filaments 30 at the pointed tip 60 to spread the paint 104.

The rounded tip 62 is superior to the pointed tip 60, having a greater number of filaments 30 to avoid being easily damaged, and a slightly wider shape to distribute paint 104.

The flat tip 64 is the shape with the best characteristics. Less easily damaged than the other shapes, the flat tip 64 has the cleanest paint delivery characteristics.

Rounded intermediate edges 68 are advantageous over straight intermediate edges 66 because rounded intermediate edges 68 increase the cross-sectional area of the brush head 18, in turn increasing its internal volume, without detrimentally affecting its performance.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A paint brush comprising:

a. a brush head having a substantially trapezoidal cross-sectional shape;

b. two opposite sides of equal length;

c. two opposite sides of disparate length;

d. the substantially trapezoidal cross-sectional shape having blunt corners; and e. wherein the two opposite sides of equal length are each at least double the length of any other side.

2. The paint brush of claim 1, wherein only the two opposite sides of disparate length are parallel.

3. The paint brush of claim 1, wherein only two sides are parallel.

4. The paint brush of claim 1, wherein the shorter of the two opposite sides of disparate length is curved.

5. The paint brush of claim 3, wherein the two opposite sides of equal length each have a curved shape.

6. The paint brush of claim 1, wherein two of the four sides are parallel.

7. The paint brush of claim 1, wherein two of the four sides are parallel and two of the four sides are perpendicular.

8. A paint brush comprising:

a. a brush head having a substantially trapezoidal cross-sectional shape;

b. two opposite sides of equal length;

c. two opposite sides of disparate length;

d. wherein the two opposite sides of equal length are each at least double the length of any other side; and e. wherein all four sides are straight.

9. The paint brush of claim 8, the substantially trapezoidal cross-sectional shape having pointed corners.

10. The paint brush of claim 8, wherein only the two opposite sides of disparate length are parallel.

11. The paint brush of claim 8, wherein only two sides are parallel.

12. The paint brush of claim 11, wherein two of the four sides are parallel.

13. The paint brush of claim 8, the substantially trapezoidal cross-sectional shape having rounded corners.

14. The paint brush of claim 8, the substantially trapezoidal cross-sectional shape having blunt corners.

15. A paintbrush comprising:

a. a cross-section;

b. a handle having a width and a length;

c. a ferrule;

d. a brush head constructed of filaments, the brush head interfaced to the handle by the ferrule;

e. wherein the cross-section is a plane perpendicular to the filaments and of a non-triangular shape;

f. wherein the cross-section has a leading edge, a first side, a second side, and a trailing edge;

g. wherein the first side and the second side are each at least double the length of the leading edge;

h. wherein the leading edge is longer than the trailing edge; and i. wherein the trailing edge is a straight line.

16. A paintbrush comprising:

a. a cross-section;

b. a handle having a width and a length;

c. a ferrule;

d. a brush head constructed of filaments, the brush head interfaced to the handle by the ferrule;

e. wherein the cross-section is a plane perpendicular to the filaments and of a non-triangular shape;

f. wherein the cross-section has a leading edge, a first side, a second side, and a trailing edge;

g. wherein the first side and the second side are each at least double the length of the leading edge;

h. wherein the leading edge is longer than the trailing edge; and i. wherein the trailing edge is a curve.

17. A paint brush comprising:

a. a handle;

b. a ferrule;

c. a brush head held to the handle by the ferrule, the brush head constructed of filaments, the brush head having a narrow side and a broad side;

d. wherein brush head has a cross-sectional shape, the cross-sectional shape that of a triangle;

e. wherein the cross-sectional shape has three sides—two sides of equal length and one side of lesser length;

f. wherein the one side of lesser length is straight;

g. wherein the two sides of equal length meet and form a tip; and h. wherein the tip is blunt.

18. A paint brush comprising:

a. a handle;

b. a ferrule;

c. a brush head held to the handle by the ferrule, the brush head constructed of filaments, the brush head having a narrow side and a broad side;

d. wherein brush head has a cross-sectional shape, the cross-sectional shape that of a triangle;

e. wherein the cross-sectional shape has three sides—two sides of equal length and one side of lesser length;

f. wherein the one side of lesser length is straight;

g. wherein the two sides of equal length meet and form a tip; and h. wherein the tip is rounded.

* * * * *